US006444007B1

(12) United States Patent
Knott et al.

(10) Patent No.: US 6,444,007 B1
(45) Date of Patent: Sep. 3, 2002

(54) PRODUCTION OF METAL FOAMS

(75) Inventors: Wilfried Knott; Andreas Weier, both of Essen (DE)

(73) Assignee: Goldschmidt AG, Essen (DE)

( * ) Notice: Subject to any disclaimer, the term of this patent is extended or adjusted under 35 U.S.C. 154(b) by 0 days.

(21) Appl. No.: 09/511,216

(22) Filed: Feb. 23, 2000

(30) Foreign Application Priority Data

Feb. 24, 1999 (DE) ..... 199 07 855

(51) Int. Cl.[7] ..... B22F 3/10
(52) U.S. Cl. ..... 75/228; 419/2
(58) Field of Search ..... 75/228; 419/2

(56) References Cited

U.S. PATENT DOCUMENTS

| | | | | | |
|---|---|---|---|---|---|
| 2,895,819 | A | * | 7/1959 | Fiedler | 75/20 |
| 2,983,597 | A | * | 5/1961 | Elliott | 75/20 |
| 3,087,807 | A | * | 4/1963 | Allen et al. | 75/20 |
| 3,297,431 | A | * | 1/1967 | Ridgeway, Jr. | 75/20 |
| 3,300,296 | A | * | 1/1967 | Hardy et el. | 75/20 |
| 4,973,358 | A | * | 11/1990 | Jin et al. | 75/415 |
| 5,102,922 | A | * | 4/1992 | Kimura et al. | 521/145 |
| 5,151,246 | A | * | 9/1992 | Baumeister et al. | 419/2 |
| 5,393,485 | A | * | 2/1995 | Worz et al. | 419/41 |
| 5,972,285 | A | * | 10/1999 | Knott | 419/2 |

FOREIGN PATENT DOCUMENTS

| | | |
|---|---|---|
| DE | 197 44 300 A | 4/1998 |
| JP | 03-017236 | 1/1991 |
| JP | 09-241780 | 9/1997 |
| WO | WO 92/21457 | 12/1992 |

OTHER PUBLICATIONS

C.M. Ward–Close et al., (1997), "Synthesis/Processing of Lightweight Metallic Materials II", The Minerals, Metals & Materials Society, pp. 290–300.

Cheng Guiping et al., (1997), "An Approach to the Factors Influencing the Preparation of Foam Metal by infiltration Method", Southeast University, pp. 1–4.

* cited by examiner

*Primary Examiner*—Daniel J. Jenkins
(74) *Attorney, Agent, or Firm*—Scully, Scott, Murphy & Presser

(57) ABSTRACT

A process for producing metal foams comprising mixing one or more metal powders, if desired combined with particulate metallic or nonmetallic, e.g., mineral, additives of varying particle size, with a gas-liberating blowing agent; optionally preheating the mixture in an open or closed mold to a temperature below the decomposition temperature of the blowing agent; subsequently heating the mixture to a temperature above the melting point of the lowest-melting metal in such a way that the temperature rises from the equilibrium decomposition temperature of the blowing agent to the melting point of the metal in a time which is shorter than the time required to reach the equilibrium state in the blowing agent/blowing gas system at this temperature and subsequently cooling the resulting metal foam to a temperature below the melting point of the lowest-melting metal is provided as well as foamed metal bodies obtained using the inventive process.

14 Claims, 1 Drawing Sheet

PRODUCTION OF METAL FOAMS

DESCRIPTION

1. Field of the Invention

The present invention relates to a process for producing metal foams and to foamed metal bodies obtained using the process of the present invention.

2. Background of the Invention

The prior art for producing metal foams includes essentially five principle procedures. These five principle procedures include:

1. Compacting metal powders together with suitable blowing agents and heating the compressed green bodies obtained in this way to temperatures above the liquidus temperature of the metal matrix and above the decomposition temperature of the blowing agent used;
2. Dissolving or injecting blowing gases in/into metal melts;
3. Stirring blowing agents into metal melts;
4. Sintering hollow metal spheres; and
5. Infiltrating metal melts into porous bodies which are removed after solidification of the melt.

Regarding prior art procedure 1: DE 197 44 300 A is concerned with the production and use of porous light metal parts or light metal alloy parts, in which the bodies pressed from a powder mixture (light metal alloy or Al alloy and blowing agent) are heated in a heatable closed vessel provided with inlet and outlet openings to temperatures above the decomposition temperature of the blowing agent and/or melting point of the metal or alloy.

Regarding prior art procedure 2: JP 03017236 A describes a process for producing metal articles containing voids by dissolving gases in a metal melt and then inducing foaming by sudden reduction of pressure. Cooling of the melt stabilizes the foam obtained in this way.

Wo 92/21457 teaches the production of Al foam or Al alloy foam by injecting gas under the surface of a molten metal, with abrasive materials, e.g. SiC, $ZrO_2$, etc., serving as stabilizers.

Regarding prior art procedure 3: According to JP 09241780 A, metallic foams are obtained by means of controlled liberation of blowing gases by first melting the metals at temperatures below the decomposition temperature of the blowing agent used. Subsequent dispersion of the blowing agent in the molten metal and heating the matrix above the temperature required for liberation of blowing gases forms a metal foam.

Regarding prior art procedure 4: Ultralight Ti-6Al-4V hollow sphere foams are produced from hollow metallic spheres derived from the thermal decomposition of hydrogenated Ti-6Al-4V hollow spheres at 600° C. which are then sintered at temperatures of ≧1000° C. (Synth./Process. Lightweight Met. Mater. II, Proc. Symp. 2nd (1997), 289–300).

Regarding prior art procedure 5: After infiltration of molten aluminum into a porous filler, foamed aluminum is obtained by removal of the filler from the solidified metal (Zhuzao Bianjibu (1997) (2) 1–4; ZHUZET, ISSN: 1001–4977).

On examination of the prior art, it can be seen that the processes which provide a precompacted green body containing blowing agents are complicated and expensive and are not suitable for mass production of goods. Moreover, in all the above processes, the desired temperature difference between the melting point of the metal to be foamed and the decomposition temperature of the blowing agent used should be very small, otherwise undesirable decomposition of the blowing agent takes place during compaction or later in the melting phase.

Analogously, these considerations also apply to the introduction of blowing agents into metal melts.

The sintering of preformed hollow spheres to give a metallic foam is at most of academic interest, since the production of the hollow spheres requires a complicated process technology.

The infiltration technique in which the porous filler has to be painstakingly removed from the foam matrix can be evaluated similarly.

The dissolution or injection of blowing gases in/into metal melts is not suitable for the manufacture of workpieces having a shape close to the final shape, since a system consisting of the melt with occluded gas bubbles is not sufficiently stable over time to be able to be processed in moulds.

In view of the above backgrounds, it is an object of the present invention to provide a simple process for the production of metal foams which is at the same time suitable for mass production and allows the production of parts having a shape close to the final shape at little cost and is based on the use of solid, gas-generating blowing agents.

SUMMARY OF THE INVENTION

It has surprisingly been found that the production of metallic foams requires neither compacted green bodies provided with blowing agents nor the introduction of blowing agents into molten metals, if particular process engineering-boundary conditions are adhered to.

In the simplest embodiment of the process of the present invention, a porous metal body can be easily produced by mixing a small amount of a gas-generating blowing agent with a powdered metal to be foamed and heating this mixture quickly. The process of the present invention provides a porous metal body.

The abovementioned object is thus achieved, in a first embodiment, by a process for producing metal foams, which comprises the steps of: mixing one or more metal powders, optionally combined with particulate metallic or nonmetallic, e.g., mineral, additives of varying particle size, with a gas-liberating blowing agent; optionally, preheating the mixture in an open or closed mold to a temperature below the decomposition temperature of the blowing agent; subsequently heating the mixture to a temperature above the melting point of the lowest-melting metal in such a way that the temperature rises from the equilibrium decomposition temperature of the blowing agent to the melting point of the metal in a time which is shorter than the time required to reach the equilibrium state in the blowing agent/blowing gas system at this temperature; and cooling the resulting metal foam to a temperature below the melting point of the lowest-melting metal in the metal mixture.

DETAILED DESCRIPTION OF THE INVENTION

Figure 1:
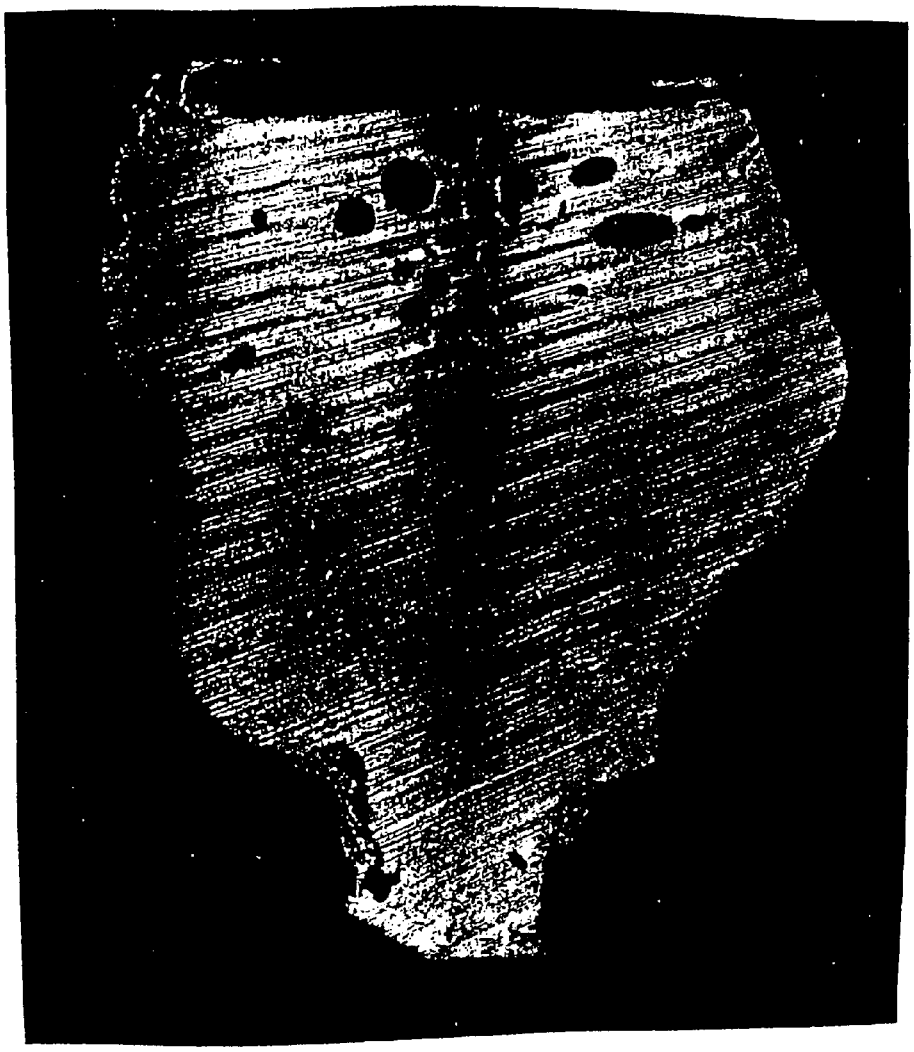
FIG. 1 shows the longitudinal section of a porous steel body produced in Example 1 using the process of the present invention.

The process of the present invention dispenses with prior art methods which are responsible for the build-up of mechanical resistance acting against the pressure of the blowing agent in the metal matrix to be foamed. However, it is essential to the present invention that the temperature rises from the equilibrium decomposition temperature of the material or material mixture generating the blowing gases to the melting point of the metal to be foamed or the melting point of the lowest-melting metal in a metal mixture in a time which is shorter than the time required to reach the equilibrium state in the blowing agent/blowing gas system at this temperature.

The rapid attainment of the melting point of the lowest-melting metal in a metal mixture to be foamed allows, advantageously, the utilization of components (unmelted metal particles) compatible with the final matrix as nucleating agents to promote the uniformity of the metal foam.

The rapid heating of the reaction mixture is achieved in the present invention, for example, by means of induction heating or irradiation with a laser beam. However, in a particular modification of the process described, the heat of reaction of a rapid, strongly exothermic process (e.g., the aluminothermic reduction) can, either in place of, or in addition to the external energy input, assume the task of providing both heat of melting for the metal to be foamed and also heat of decomposition for the blowing agent used.

In principle, all meltable metals or metal alloys can be foamed according to the present invention. For the purposes of the present invention, particular preference is given to using aluminum (Al), iron (Fe) or an alloy thereof as a metal powder. In contrast to the customary prior art, it is possible in the present invention to produce not only foams of light metals, but also those of heavy metals in foam form.

For the purposes of the present invention, particular preference is given to using commercially available magnesium hydride as gas-liberating blowing agents. However, apart from magnesium hydride, it is also possible to use metal hydrides known per se, for example, titanium hydride; and also carbonates, for example, calcium carbonate, potassium carbonate, sodium carbonate, sodium bicarbonate; hydrates, for example, aluminum sulfate hydrate, alum, aluminum hydroxide; or readily vaporizable substances such as mercury compounds or pulverized organic substances. It is of course particularly preferred in the context of the present invention for the gas-liberating blowing agent to contain the same metal ions as are also present in the metal to be melted.

The amount of gas-liberating blowing agent to be used according to the process of the present invention is usually very small. Thus, amounts of blowing agent on the order of some tenths of a percent by weight are usually sufficient. For the purposes of the present invention, amounts of blowing agent of from 0.1 to 10% by weight, in particular from 0.2 to 5% by weight, based on metal powder, have been found to be particularly useful.

Particularly in the latter case, a person skilled in the art will have found it totally surprising that, for example, steel having a melting point of from 1500° C. to 1600° C. can be foamed with the aid of magnesium hydride ($T_{decomposition} \geqq 280°$ C.).as a blowing agent, if small amounts of $MgH_2$ are added to a THERMIT® powder mixture and the aluminothermic reduction of iron oxide to iron is then induced by ignition of the reaction mixture.

The regulus obtained after cooling, as shown in FIG. 1 after sawing open in the longitudinal direction, contains gas pores caused by hydride decomposition in the metallic iron.

This observation is quite astounding since a precompaction of the powder mixture was not necessary, nor was the premise of a very small temperature difference between the melting point of the metal and the decomposition temperature of the blowing agent fulfilled. Furthermore, this observation differs from the processes based on subsequent introduction of blowing agents into the metal melt, since the starting material was used in the form of a mixture of solids.

At the same time, this embodiment of the present invention opens up the wide field of "reactive foaming" of metals in which an exothermic process (for example, a reduction) is coupled in time and space with the foaming process (blowing agent decomposition and formation of the metal melt).

The fact that the mechanical pretreatment of the foam-forming mixture is dispensable in the process of the present invention allows virtually any shaping of the semifinished foamed parts and provides a route to mass production.

A further embodiment of the present invention provides a semifinished foamed metal part which is obtainable using the process of the present invention.

The quality of the metal foam obtained by the novel process (pore size, pore distribution, etc.) depends, for example, on the cooling rate of the metal mass.

The following example is given to illustrate the present invention and to demonstrate some advantages that can arise therefrom.

EXAMPLE

In a crucible, 6 kg of a commercial THERMIT® mixture was admixed with 200 g (3.3% by mass) of autocatalytically prepared magnesium hydride. The aluminothermic reduction reaction was induced by means of a THERMIT® igniter. After the vigorous reaction had ceased, the mixture was allowed to cool in the crucible. The metallic regulus is freed of slag residues and sawn open in the longitudinal direction. FIG. 1 shows the longitudinal section of the porous steel body.

While the present invention has been particularly shown and described with respect to preferred embodiments thereof, it will be understood by those skilled in the art that the foregoing and other changes in form and detail may be made without departing from the scope and spirit of the present invention should not be limited to the exact forms described and illustrated but fall within the scope of the appended claims.

What is claimed is:

1. A process for producing metal foams comprising the steps of:

(a) mixing one or more metal powders with a gas-liberating blowing agent;

(b) heating the mixture to a temperature above the melting point of the lowest-melting metal of said mixture so that the temperature rises from the equilibrium decomposition temperature of the blowing agent to the melting point of the metal in a time which is shorter than the time required to reach the equilibrium state in the blowing agent at this temperature, thereby obtaining a metal foam; and (c) cooling the resulting metal foam to a temperature below the melting point of the lowest-melting metal in said mixture.

2. The process of claim 1, wherein step (b) is carried out by induction heating, laser radiation, chemical heat of reaction, or any combination thereof.

3. The process of claim 1, wherein the gas-liberating blowing agent is a metal hydride, metal carbonate, metal hydrate, a substance which vaporizes at the reaction temperature or mixtures thereof.

4. The process of claim 1, wherein the gas-liberating blowing agent is used in an amount of from 0.1 to 10% by weight, based on the metal powder.

5. The process of claim 4, wherein said gas-liberating blowing agent is used in an amount of from 0.2 to 5% by weight, based on the metal powder.

6. The process of claim 3, wherein the gas-liberating blowing agent is magnesium hydride, titanium hydride, calcium carbonate, sodium bicarbonate, alumium sulfate hydrate, alum, aluminum hydroxide or a mercury compound.

7. The process of claim 6, wherein said gas-liberating blowing agent is magnesium hydride.

8. The process of claim 1, wherein step (a) further comprises mixing one or more metallic or nonmetallic additives of varying particle size with said one or more metal powders and said gas-liberating blowing agent.

9. The process of claim 1, wherein prior to conducting step (b) the mixture in step (a) is preheated to a temperature below the decomposition temperature of said gas-liberating blowing agent.

10. The process of claim 9, wherein said preheating step is carried out in an open or closed mold.

11. The process of claim 1, wherein said one or more metal powders comprises a metal or metal alloy that is capable of being melted and foamed.

12. The process of claim 11, wherein said metal alloy comprises Al, Fe or a mixture thereof.

13. The process of claim 1, wherein said one or more metal powders is THERMIT® steel and said gas-liberating blowing agent is magnesium hydride.

14. A semifinished foamed metal part produced by the process of claim 1.

* * * * *